US007992391B2

(12) United States Patent
Caboche et al.

(10) Patent No.: US 7,992,391 B2
(45) Date of Patent: Aug. 9, 2011

(54) TRANSVERSE WALL OF A COMBUSTION CHAMBER PROVIDED WITH MULTI-PERFORATION HOLES

(75) Inventors: Gerard Edouard Emile Caboche, Bretigny sur Orge (FR); Claude Gautier, Savigny le Temple (FR); Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 1020 days.

(21) Appl. No.: 11/670,534

(22) Filed: Feb. 2, 2007

(65) Prior Publication Data

US 2007/0180834 A1 Aug. 9, 2007

(30) Foreign Application Priority Data

Feb. 9, 2006 (FR) ..... 06 50459

(51) Int. Cl.
*F02C 1/00* (2006.01)

(52) U.S. Cl. ..... 60/756; 60/755

(58) Field of Classification Search ..... 60/752, 60/754–760

See application file for complete search history.

(56) References Cited

U.S. PATENT DOCUMENTS 4,241,586 A * 12/1980 Caruel et al. ..... 60/738
5,271,219 A * 12/1993 Richardson ..... 60/804
5,396,759 A 3/1995 Richardson
5,419,115 A * 5/1995 Butler et al. ..... 60/804
5,581,999 A * 12/1996 Johnson ..... 60/804
5,956,955 A * 9/1999 Schmid ..... 60/748
6,155,056 A * 12/2000 Sampath et al. ..... 60/756
6,164,074 A 12/2000 Madden et al.
6,557,349 B1 * 5/2003 Young et al. ..... 60/752
2002/0178734 A1 12/2002 Stastny
2004/0083735 A1 5/2004 Borns et al.
2007/0256418 A1 * 11/2007 Mueller et al. ..... 60/752

FOREIGN PATENT DOCUMENTS

FR 2 637 675 4/1990

OTHER PUBLICATIONS

U.S. Appl. No. 12/199,182, filed Aug. 27, 2008, Pieussergues, et al.

* cited by examiner

*Primary Examiner* — Michael Cuff
*Assistant Examiner* — Young Choi
(74) *Attorney, Agent, or Firm* — Oblon, Spivak, McClelland, Maier & Neustadt, L.L.P.

(57) ABSTRACT

An annular wall which transversely connects longitudinal walls of an annular combustion chamber of a turbine engine is disclosed. The wall is essentially flat, inclined in relation to a longitudinal axis of the turbine engine, and includes a plurality of deflectors, each formed by an essentially rectangular flat sheet. The deflectors are mounted on the wall and each includes an aperture for the installation of a fuel injection system, a plurality of multi-perforation holes formed in relation to the deflectors around their aperture so as to allow a passage of air intended for the cooling of the deflectors, and a flow forcing unit which forces the flow of air for cooling the deflectors to flow radially around the fuel injection systems.

10 Claims, 3 Drawing Sheets

TRANSVERSE WALL OF A COMBUSTION CHAMBER PROVIDED WITH MULTI-PERFORATION HOLES

BACKGROUND TO THE INVENTION

The present invention relates to the general domain of combustion chambers of a turbine engine. It relates more particularly to the wall of an annular combustion chamber which is intended to connect transversely the longitudinal walls of the said chamber.

Typically, an annular combustion chamber of a turbine engine is formed from two longitudinal annular walls (one internal wall and one external wall), which are connected upstream by a transverse wall, likewise annular, forming the base of the chamber.

The base of the chamber is provided with a plurality of essentially circular apertures which are distributed regularly over the whole of the circumference. Installed in these apertures are injection systems which mix the air and the fuel. This pre-mixture is intended to be burned in the interior of the combustion chamber.

In order to protect the base of the chamber against the very high temperatures of the gases deriving from the combustion of the air/fuel mixture in the combustion chamber, deflectors which form heat shields are likewise mounted in each aperture of the base of the chamber around the injection systems.

The base of the chamber generally has a plurality of multi-perforation holes which are created in the areas opposite the deflectors. These multi-perforation holes are passages for the air which is intended for cooling the deflectors by impact.

In addition to this, the base of the chamber has the shape of an essentially flat ring, which is centred on the longitudinal axis of the turbine engine. This may be either perpendicular to the longitudinal axis of the turbine engine or inclined (towards the inside or the outside) in relation to this axis.

Likewise, the deflectors are generally in the form of a metal sheet of approximately rectangular shape, which is centred on the axis of symmetry of the injection system and which is soldered to the base of the chamber.

In the situation in which the base of the chamber is inclined in relation to the longitudinal axis of the turbine engine, it has the shape of a truncated cone with the axis of symmetry of the injection systems directed towards the inside or the outside. In operation, the result of this is that the distance separating the base of the chamber from each deflector mounted in the apertures is not constant when the axis of symmetry of the injection systems runs out of the vertical. In addition, cooling by multi-perforation of the deflectors is not homogenous, which leads to substantial deterioration of the deflectors, which is particularly prejudicial to the service life of the combustion chamber.

OBJECT AND SUMMARY OF THE INVENTION

The object of the present invention is therefore to overcome such disadvantages by proposing a transverse wall of the combustion chamber which is in the shape of a truncated cone, so allowing for effective and homogenous cooling of the deflectors.

This object is achieved thanks to an annular wall intended to connect transversely longitudinal walls of an annular combustion chamber of a turbine engine, said wall being essentially flat, inclined in relation to a longitudinal axis of the turbine engine, and comprising a plurality of deflectors, each formed by an essentially rectangular flat sheet, said deflectors being mounted on the annular wall and each comprising an aperture for the installation of a fuel injection system and a plurality of multi-perforation holes, formed in relation to the deflectors around their aperture, so as to allow a passage of air intended for the cooling of the said deflectors, and in which, according to the invention, each deflector comprises means to force the flow of air for cooling the deflectors to flow radially in relation to the longitudinal axis of the turbine engine around the fuel injection systems.

By creating means to force the flow of air for cooling the deflectors to flow radially around the fuel injection systems, it is possible to obtain homogenous cooling over the entire surface of the deflectors. Accordingly, any risk of deterioration of the defectors is avoided. The service life of the base of the chamber will therefore be increased.

According to one embodiment of the invention, each deflector comprises at least two deformations forming chicanes for the movement of the flow of cooling air, said deformations extending radially in relation to the longitudinal axis of the turbine engine on both sides of the aperture of the deflector.

The presence of such chicanes allows the flow of cooling air for the deflectors to be guided radially around the fuel injection systems.

The deformations of the deflector may be in the form of throats, each throat having a depth of, preferably, between 1 and 2 mm.

According to another embodiment of the invention, the distance between the respective external radial ends of the wall and the deflectors at the level of a radial plane of symmetry of the deflectors is less than or greater than that at the level of the lateral ends of the deflectors.

The presence of these deviations in distances at the level of the respective external radial ends of the wall and the deflectors likewise allows the cooling air to flow around the fuel injection systems.

The present invention likewise has as its object a combustion chamber and a turbine engine provided with a combustion chamber comprising a transverse wall such as described heretofore.

BRIEF DESCRIPTION OF THE DRAWINGS

Other characteristics and advantages of the present invention can be derived from the description provided hereinafter, by reference to the appended drawings, which illustrate an embodiment of the invention in a non-limitative manner. In the Figures.

DETAILED DESCRIPTION OF EMBODIMENTS

Figure 1:
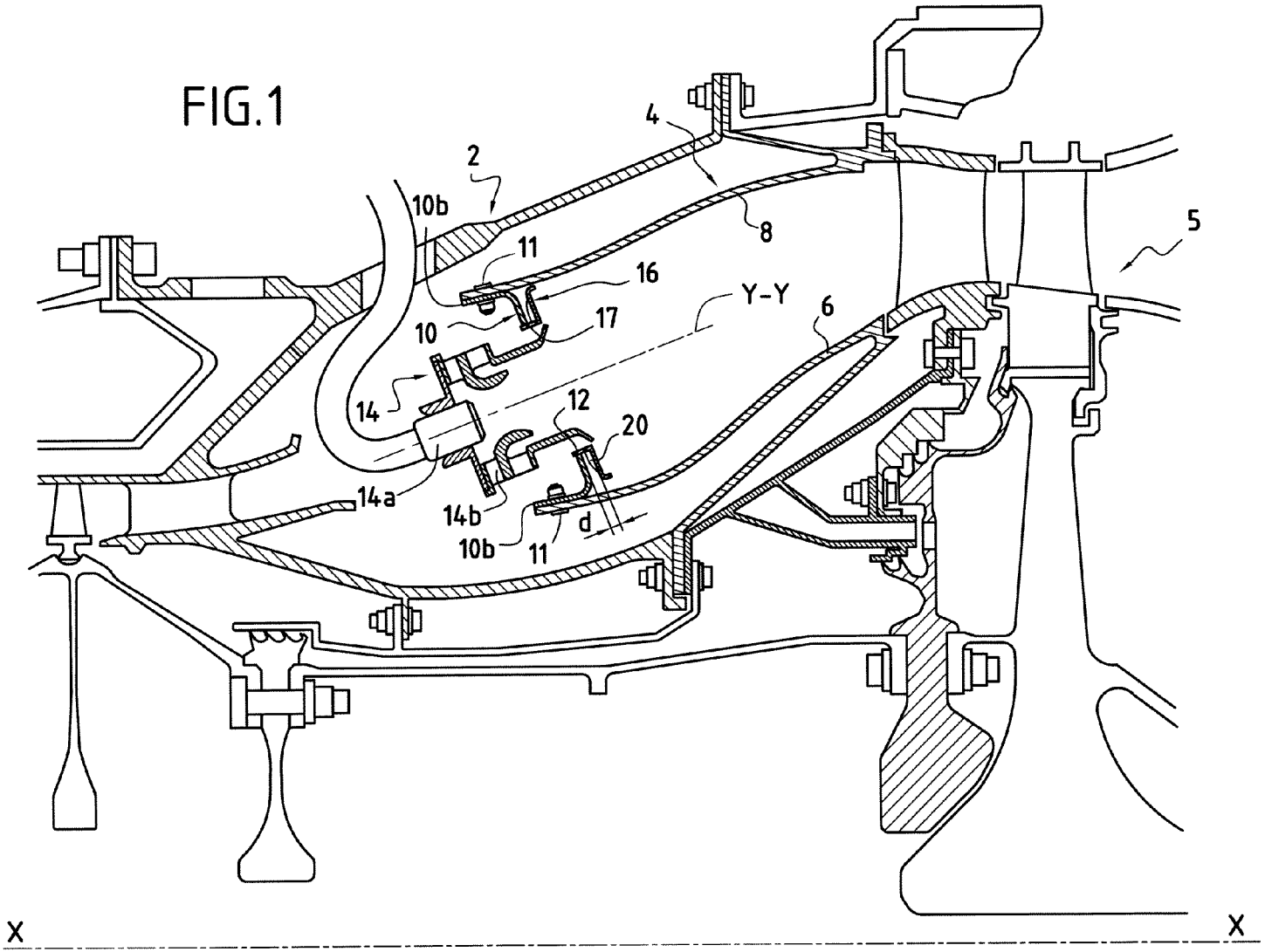
FIG. 1 is a longitudinal section of a combustion chamber of a turbine engine in its surroundings.

FIG. 1 shows a combustion chamber for a turbine engine. Such a turbine engine comprises in particular a compression section (not shown), in which the air is compressed before being injected into a casing of the chamber 2, then into a combustion chamber 4 mounted in its interior.

The compressed air is introduced into the combustion chamber and mixed with fuel before being combusted. The gases deriving from this combustion are then directed to a high-pressure turbine 5 arranged at the outlet of the combustion chamber 4.

The combustion chamber 4 is of the annular type. It is formed from an internal annular wall 6 and an external annular wall 8, which are connected upstream (in relation to the direction of flow of the combustion gas in the combustion chamber) by a transverse wall 10 forming the base of the chamber.

The internal wall 6 and external wall 8 of the combustion chamber extend in accordance with a longitudinal axis which is slightly inclined in relation to the longitudinal axis X-X of the turbine engine. They can be made of metallic or composite material The transverse wall 10 of the combustion chamber is generally obtained by the shaping of a metallic sheet. Its thickness is typically of the order of about 1.5 mm.

The transverse wall 10 takes the form of a ring centred on the longitudinal axis X-X of the turbine engine. It comprises a principal part 10*a*, essentially flat (FIG. 2), which is extended at its two free ends by the parts 10*b*, folded in the upstream direction (FIG. 1).

In addition to this, the principal part 10*a* of the transverse wall is inclined towards the outside of the ring in relation to the longitudinal axis X-X of the turbine engine, i.e. the transverse wall has essentially the shape of a truncated cone.

The invention applies equally to transverse walls of which the principal part is inclined towards the interior of the ring (i.e. towards the longitudinal axis X-X of the turbine engine).

The principal part 10*a* of the transverse wall 10 is provided with a plurality of apertures 12, eighteen in number, for example, and of circular shape, which are spaced regularly over the entire circumference of the transverse wall 10.

These apertures 12 are each intended to accommodate an injection system 14 for an air/fuel mixture. The latter comprises, in particular, a fuel injection nozzle 14*a* and a bowl element 14*b* provided with air swirl elements.

The nozzle and the bowl element are centred on an axis of symmetry Y-Y of the injection system 14. Given that the transverse wall 10 of the combustion chamber is a truncated cone in shape, this axis of symmetry Y-Y is inclined in relation to the longitudinal axis Y-Y of the turbine engine.

A deflector 16 forming a heat shield is likewise mounted in each aperture 12 of the transverse wall 10 around the injection systems 14.

Figure 2:
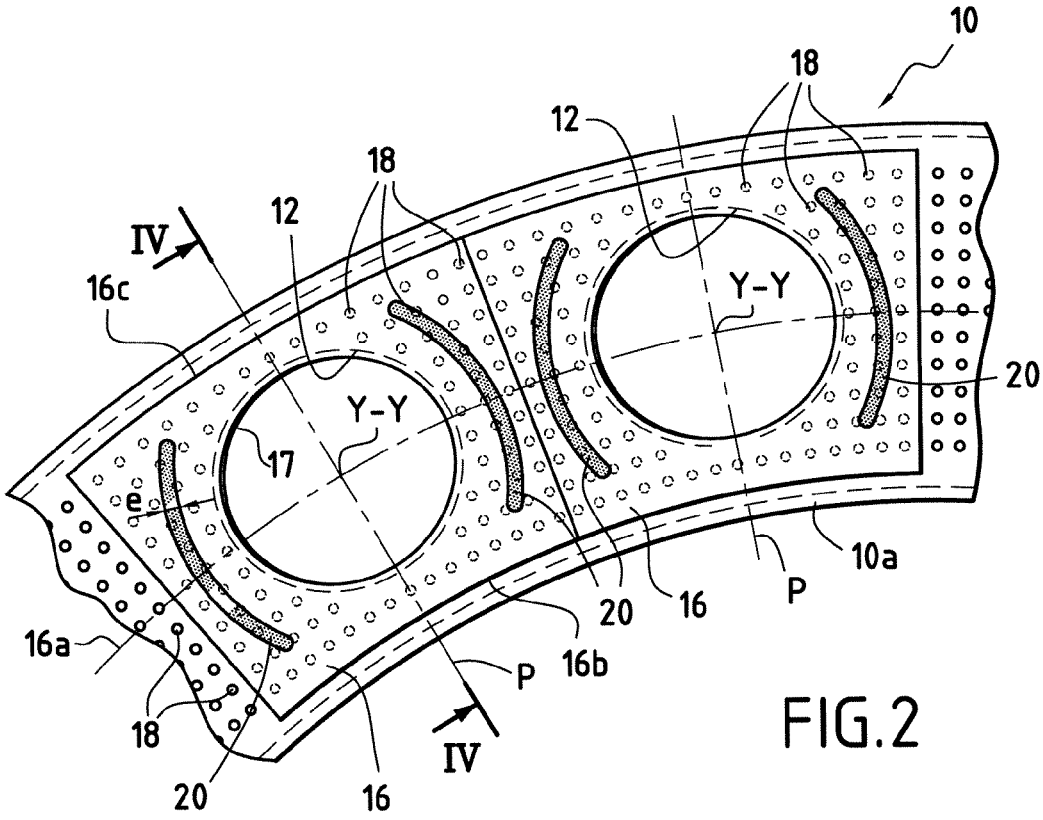
FIG. 2 is a partial view of the transverse wall according to an embodiment of the invention.

As represented in FIG. 2, the deflectors 16 are flat sheets essentially rectangular in shape, each of which has a circular aperture 17 centred on the axis of symmetry Y-Y of the injection systems to allow these to pass through. They allow the transverse wall 10 to be protected against the high temperatures of the combustion gases.

A plurality of multi-perforation holes 18 forming a mesh pierce through the transverse wall 10 of the combustion chamber around each aperture 12 opposite the deflectors 16. These allow the air circulating around the combustion chamber to be cooled by impact with the deflectors.

In operation, due to the fact that the transverse wall 10 of the combustion chamber is in the shape of a truncated cone, it has been determined that the distance (or gap) d separating the deflectors 16 from the transverse wall is only constant (of the order of 1.5 to 4 mm) in the plane P passing through the axis of symmetry Y-Y of the injection system and the longitudinal axis X-X of the turbine engine (also referred to as the radial plane of symmetry of the deflectors—see FIG. 2), and that it varies when this radial plane of symmetry P is departed from. The variation in the gap d depends in particular on the number of injection systems equipping the combustion chamber, the height of the primary combustion zone and the mean radius of the transverse wall.

Figure 3:
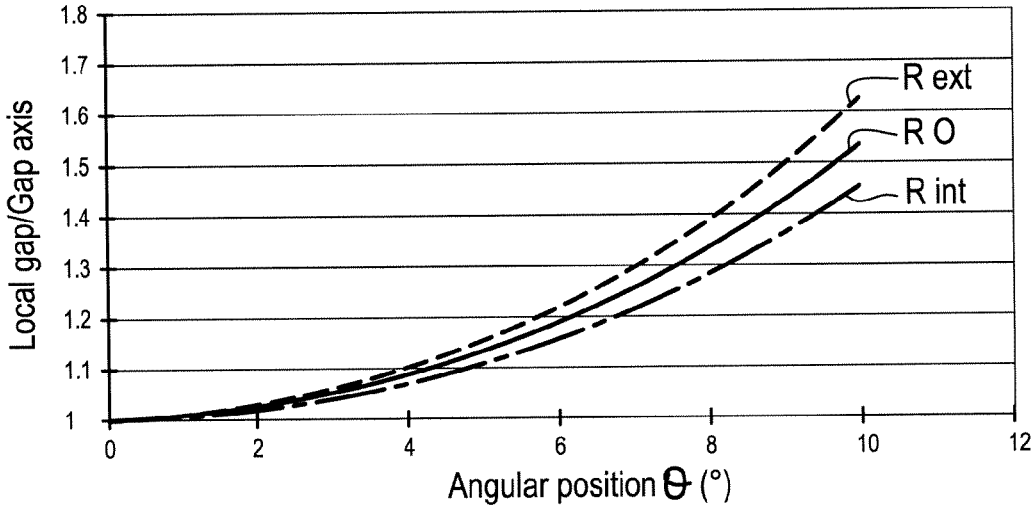
FIG. 3 represents curves showing the development of the gap between the deflectors and a transverse wall.

FIG. 3 illustrates the relative variation of the gap d as a function of the angular position θ at which the measurement of the gap d is carried out.

In this figure, the relative variation of the gap is defined as the ratio between the measurement of the gap d taken locally and the measurement taken at the level of the plane of symmetry P of the deflectors.

Likewise, the angular position θ is defined in relation to the plane of symmetry P of the deflectors (the angle of 0° corresponds to a measurement on the plane of symmetry P and the angle of 10° corresponds to a measurement on one of the angular ends of the deflector).

The curves R0, Rint and Rext of this FIG. 3 represent the relative variation of the gap when in operation, respectively for the mean radius 16*a*, for the internal radius 16*b*, and for the external radius 16*c* of the deflector 16 (these radii are shown in diagrammatical form in FIG. 2).

It can be determined that the gap d separating the transverse wall of the deflectors varies considerably towards the lateral ends of the deflectors. This results in poor cooling of the deflectors.

According to the invention, means are provided to force the flow of cooling air for the deflectors 16 to flow radially around the fuel injection systems 14.

Forcing the flow of cooling air for the deflectors 16 to flow radially around the fuel injection systems 14 allows homogenous cooling to be obtained over the whole surface of the deflectors.

Figure 4:
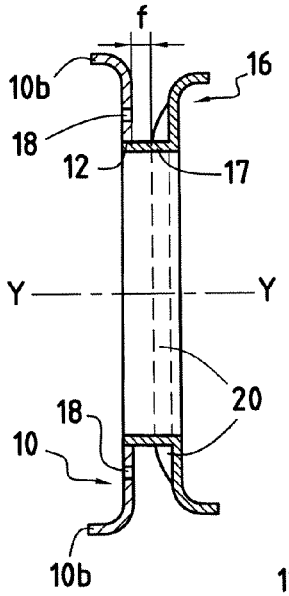
FIG. 4 is a sectional view according to IV-IV of FIG. 3.

According to a first embodiment of the invention, represented by FIGS. 2 and 4, each deflector 16 comprises at least two deformations 20 forming chicanes for through-flow of the cooling air flow.

These deformations 20 extend radially on both sides of the aperture 17 of the deflector, in order to allow the passage of the fuel injection systems 14. More precisely, they have the shape of an arc of a circle, extend between the internal radial end 16*b* and the external radial end 16*c* of the deflector and can be symmetrical in relation to the radial plane of symmetry P of the deflectors.

The deformations 20 are arranged in such a way that the central delivery of air flowing radially around the fuel injection systems and, delimited laterally by the two deformations, is equal to the sum of the external deliveries of air flowing radially between each deformation and the corresponding lateral end of the deflector 16.

In addition to this, the deformations 20 are preferably formed in the areas of the deflector which are not facing the multi-perforation holes.

As shown in FIG. 4, the deformations are advantageously in the form of throats 20 which are, for example, formed by shaping the deflectors 16.

In this case, the thickness e of the throats 20 (FIG. 2) can be between 1 and 2 mm. In addition to this, the depth of the throats is such that the distance f between the base of a throat 20 and the transverse wall 10 (FIG. 4) is constant (for example of the order of 0.3 to 0.5 mm).

Such deformations can also be applied to the transverse walls, of which the multi-perforation holes 18 form a square mesh (the rows of holes are aligned in the radial and tangential direction—situation in FIG. 2)—such that the transverse walls of which the multi-perforation holes form an equilateral mesh (the holes are arranged by rows in fives in relation to one another).

Figure 5:
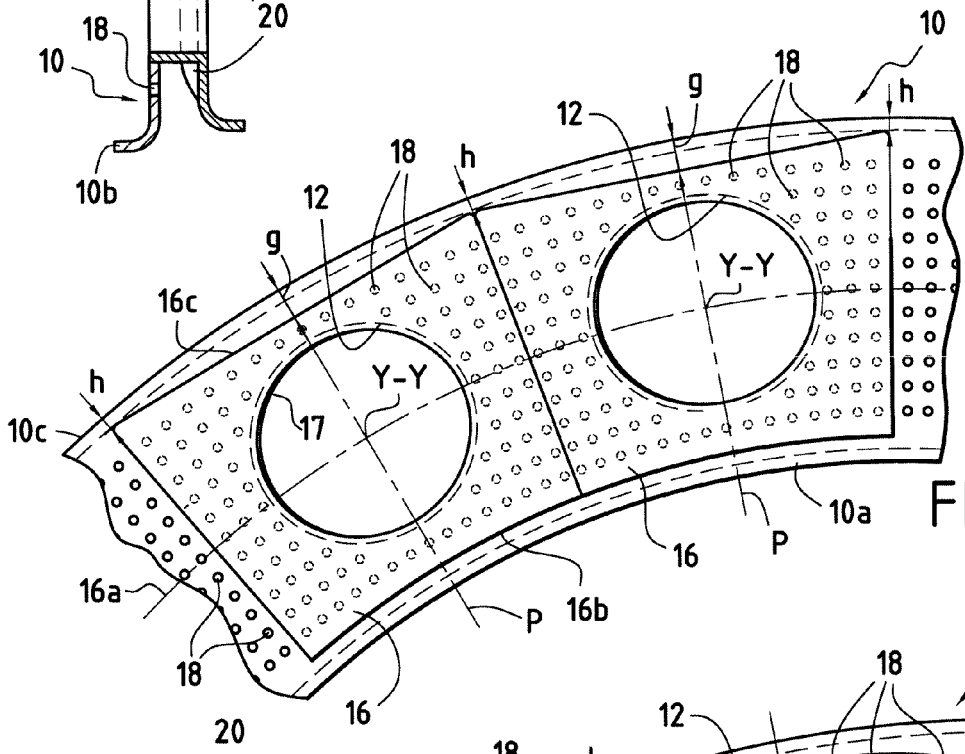
FIGS. 5 and 6 are partial views of transverse walls according to another embodiment of the invention.
Figure 6:
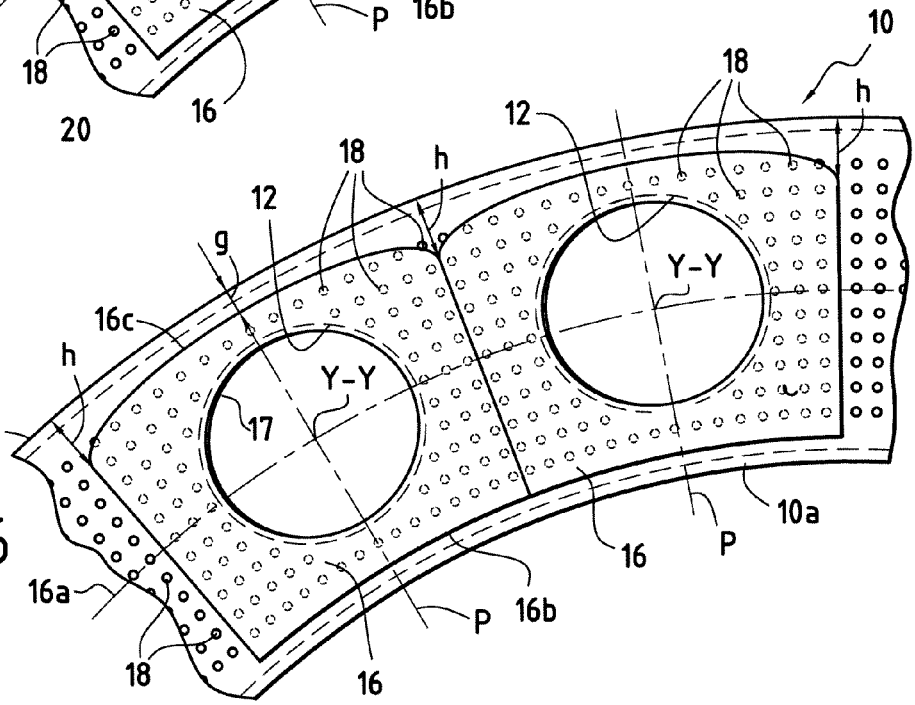

FIGS. 5 and 6 represent another embodiment of the means for forcing the flow of cooling air for the deflectors to flow radially around the fuel injection systems according to the invention.

The distance g is cited as the distance between the respective external radial ends 10*c*, 16*c* of the transverse wall 10 and the deflectors 16 which is measured at the level of the radial plane of symmetry P of the deflectors. The distance between the respective external radial ends 10*c*, 16*c* of the transverse wall 10 and the deflectors 16 which is measured at the level of the lateral ends of the deflectors is cited as h.

Because each deflector 16 is symmetrical in relation to its radial plane of symmetry P, the result is that the distance cited as h is identical to the two lateral ends of the deflector.

In an embodiment represented in FIG. 5, each deflector 16 is arranged in such a way that the distance g defined heretofore is greater than the distance h.

In another embodiment represented in FIG. 6, each deflector 16 is arranged in such a way that the distance g is less than the distance h. This can be obtained, for example, by curving the external radial end 16*c* of the deflectors 16.

Whatever the embodiment may be, such a difference in the distance between the respective external radial ends of the transverse wall and the deflectors allows the cooling air flow to flow radially around the fuel injection systems. The ratio between the distances g and h is preferably between 1.5 and 2.

It will be noted that the application of such a distance differential can equally well be applied to the respective internal radial ends of the transverse wall and the deflectors. Accordingly, the distance between the respective internal radial ends of the wall and the deflectors at the level of the radial plane of symmetry of the deflectors can be lesser or greater than that at the level of the lateral ends of the deflectors.

The invention claimed is:

1. An annular wall transversely connecting longitudinal walls of an annular combustion chamber of a turbine engine, said wall being essentially flat and inclined in relation to a longitudinal axis of the turbine engine, the wall comprising:

a plurality of deflectors, each formed by an essentially rectangular flat sheet with an external radial end, an internal radial end, and first and second lateral ends which connect the external radial end and the internal radial end, said deflectors being mounted on the annular wall and each comprising an aperture for the installation of a fuel injection system; and a plurality of multi-perforation holes formed in relation to the deflectors around the aperture of the deflector so as to allow a passage of air for cooling the deflectors;

wherein each deflector includes a flow forcing unit which forces the air for cooling the deflectors to flow radially in relation to the longitudinal axis of the turbine engine around the fuel injection systems, wherein each deflector includes first and second deformations which form chicanes for the movement of the flow of cooling air, the first deformation is disposed between the first lateral end and the aperture and extends radially in relation to the longitudinal axis of the turbine engine from a first end to a second end and the second deformation is disposed between the second lateral end and the aperture and extends radially in relation to the longitudinal axis of the turbine engine from a third end to a fourth end, and wherein a circumferential distance between the first end and the third end is provided so as to allow passage of cooling air around the fuel injection systems.

2. The wall according to claim 1, wherein the deformations of the deflector are in the form of throats.

3. The wall according to claim 2, wherein the throats each have a thickness of between 1 and 2 mm.

4. An annular wall transversely connecting longitudinal walls of an annular combustion chamber of a turbine engine, said wall being essentially flat and inclined in relation to a longitudinal axis of the turbine engine, the wall comprising:

a plurality of deflectors, each formed by an essentially rectangular flat sheet with an external radial end, an internal radial end, and first and second lateral ends which connect the external radial end and the internal radial end, said deflectors being mounted on the annular wall and arranged circumferentially about an axis of the combustion chamber such that the lateral ends are adjacent and abutting, and each comprising an aperture for the installation of a fuel injection system; and a plurality of multi-perforation holes formed in relation to the deflectors around the aperture of the deflector so as to allow a passage of air for cooling the deflectors;

wherein each deflector includes a flow forcing unit which forces the air for cooling the deflectors to flow radially in relation to the longitudinal axis of the turbine engine around the fuel injection systems, and wherein the external radial end of the deflector is curved such that a radial distance between an external radial end of the wall and the external radial end of the deflectors at a radial plane of symmetry of the deflectors is less than a radial distance between the external radial end of the wall and the external radial end of the deflectors at the lateral ends of the deflectors.

5. The wall according to claim 1, wherein a radial distance between an external radial end of the wall and the external radial end of the deflectors at a radial plane of symmetry of the deflectors is greater than a radial distance between the external radial end of the wall and the external radial end of the deflectors at the lateral ends of the deflectors.

6. A combustion chamber of a turbine engine, comprising at least one annular wall according to claim 1.

7. A turbine engine comprising a combustion chamber having at least one annular wall according to claim 1.

8. The wall according to claim 1, wherein each deformation is arcuate and extends between an internal radial end and an external radial end of the deflector.

9. The wall according to claim 1, wherein the deformations are provided in portions of the deflector which do not face the plurality of multi-perforation holes.

10. The wall according to claim 1, wherein a circumferential distance between the second end and the fourth end is provided so as to allow passage of cooling air around the fuel injection systems.

* * * * *